US005316196A

United States Patent [19]

Reich

[11] Patent Number: 5,316,196

[45] Date of Patent: May 31, 1994

[54] FLUID DISPENSER, IN PARTICULAR FOR GLUING PARTS

[75] Inventor: Léon Reich, Nidau, Switzerland

[73] Assignee: Hormec Technic SA, Nidau, Switzerland

[21] Appl. No.: 836,346

[22] PCT Filed: Dec. 18, 1990

[86] PCT No.: PCT/EP90/02261

§ 371 Date: Mar. 3, 1992

§ 102(e) Date: Mar. 3, 1992

[87] PCT Pub. No.: WO92/00814

PCT Pub. Date: Jan. 23, 1992

[30] Foreign Application Priority Data

Jul. 5, 1990 [CH] Switzerland ..... 2248/90

[51] Int. Cl.[5] ..... B67D 5/64

[52] U.S. Cl. ..... 222/160; 222/64; 222/181; 222/399

[58] Field of Search ..... 222/64, 160, 180, 181, 222/394, 399

[56] References Cited

U.S. PATENT DOCUMENTS

| | | | |
|---|---|---|---|
| 3,074,596 | 1/1963 | Marchi | 222/180 X |
| 3,495,612 | 2/1970 | Moreland, II et al. | 222/394 X |
| 4,450,981 | 5/1984 | Haig | 222/64 X |
| 4,584,964 | 4/1986 | Engel | 118/697 |
| 4,657,094 | 4/1987 | Mosher et al. | 222/64 X |
| 4,810,659 | 3/1987 | Higo et al. | 222/399 X |
| 4,840,138 | 6/1989 | Stirbis | 118/694 |
| 5,100,031 | 3/1992 | Verborg et al. | 222/399 X |
| 5,150,822 | 9/1992 | Eitner, Jr. et al. | 222/399 X |

FOREIGN PATENT DOCUMENTS

| | | |
|---|---|---|
| 0272641 | 6/1988 | European Pat. Off. . |
| 0289763 | 11/1988 | European Pat. Off. . |
| 2438681 | 3/1975 | Fed. Rep. of Germany . |
| 558521 | 1/1975 | Switzerland . |
| 1479973 | 7/1977 | United Kingdom . |
| 1481143 | 7/1977 | United Kingdom . |

*Primary Examiner*—Andres Kashnikow
*Assistant Examiner*—Joseph A. Kaufman
*Attorney, Agent, or Firm*—Oliff & Berridge

[57] ABSTRACT

A reservoir is suspended from a support frame with two parallel arms which pivot on the transverse sides of the upright of the support frame. Two springs bent between different locations of the support frame impart to the latter different positions according to the weight of the reservoir and, therefore, according to the amount of liquid in the reservoir. The positions vary such that the level of liquid in the reservoir remains constantly at a predetermined height corresponding to a point slightly higher than the tip of the applicator needle when the applicator is placed on a bracket. The device is suitable for cyano-acrylate type adhesives and for dispensing volatile or aggressive liquids.

14 Claims, 2 Drawing Sheets

FLUID DISPENSER, IN PARTICULAR FOR GLUING PARTS

BACKGROUND OF THE INVENTION

There already exist various fluid dispensing devices designed to achieve operations such as gluing in series parts intended to be fixed permanently to each other. The Swiss patent CH-558 521, for example, describes an important element of a device of this type. Calibrated doses of fluid can thus be pumped into one or more nozzles or syringes via ducts emanating from a housing constituted by a reservoir, with no interposed gate or valve.

In a subsequent development of an apparatus of this type, a connection formed by a flexible tube was designed between the reservoir containing the fluid reserve and the applicator, thus facilitating manual operations.

SUMMARY OF THE INVENTION

The aim of this invention is to provide an improvement to fluid dispensers, in particular for gluing parts, comprising a glue reservoir, an applicator connected to the reservoir by a flexible tube and a pneumatic pulse generator for creating momentary excess pressure on the free level of fluid in the reservoir thus ejecting doses of fluid through the applicator.

In fact, it has been noted that in dispensers of this type, in order to ensure the permanent readiness of the applicator, it was necessary to place the latter during periods of rest in a position such that the tip of the downwardly pointing needle is slightly below the free level of the fluid in the reservoir. This arrangement avoids two phenomena which can occur during periods of rest if nothing is done to avoid them: droplets of liquid may fall from the tip of the needle, or the content of the tip of the needle may polymerize. However, the free level in the reservoir varies with the use of the dispenser as the reservoir empties.

With the aim of overcoming this fault, the dispenser of the invention is characterized in that the dispenser comprises, on a support, a receptacle for the applicator, means for holding the reservoir and a stabilizing arrangement, the latter ensuring that the free level remains at an approximately constant level with respect to the applicator placed in its receptacle during the functioning of the dispenser.

BRIEF DESCRIPTION OF THE DRAWINGS

A preferred embodiment of the subject of the invention will be described below, by way of example, with reference to the drawings, in which.

DETAILED DESCRIPTION OF PREFERRED EMBODIMENTS

Figures 1A, 1B, 1C:
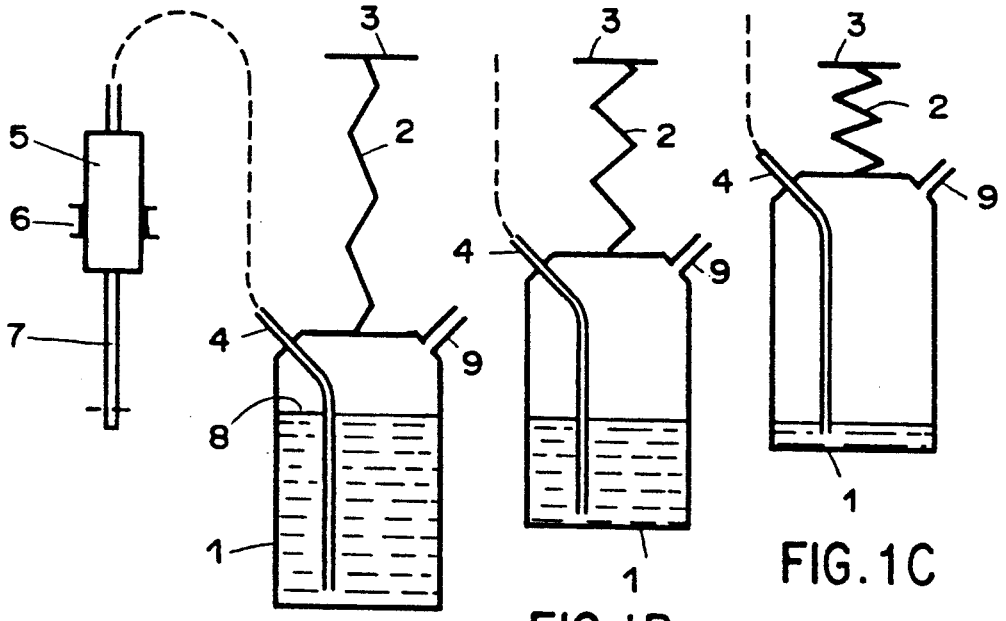
FIGS. 1*a*–1*c* are diagrammatic views showing the principle of this embodiment at different stages of dispensing.
Figure 2:
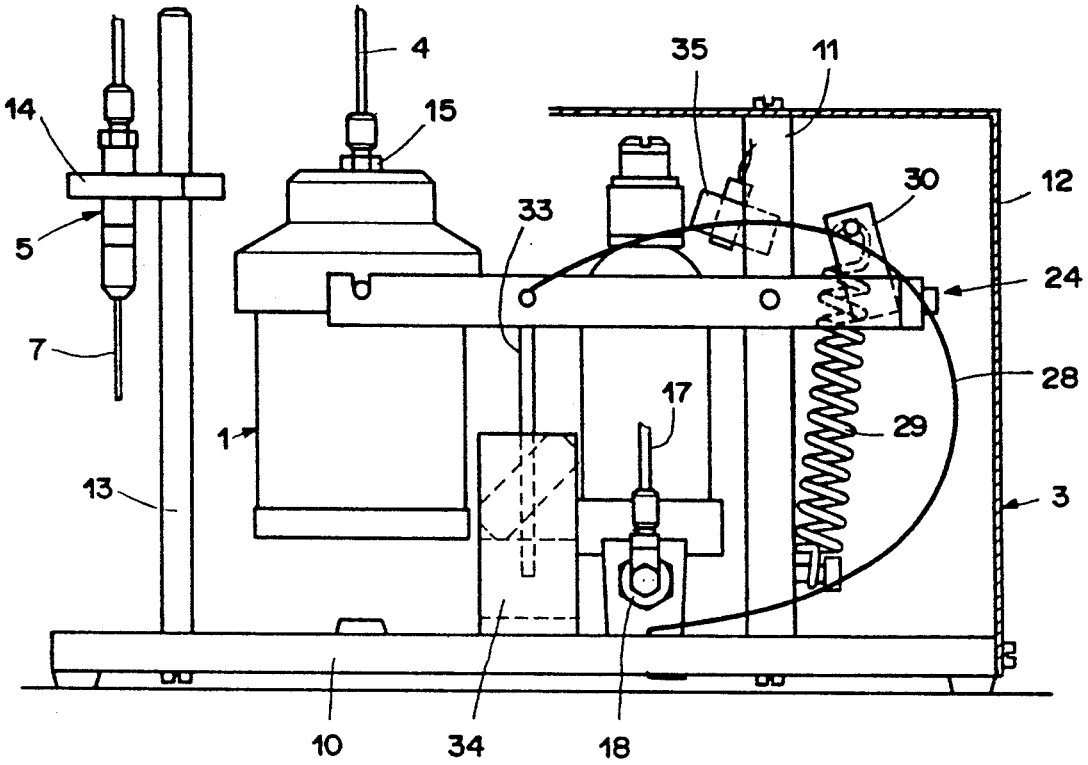
FIG. 2 is an elevation of the embodiment described.

FIG. 1 illustrates the principle of the device, i.e. a reservoir 1, of which the level of the contents may vary during the use of the device between three stages designated by A, B and C in FIG. 1. This reservoir is suspended by a spring, the characteristics of which it is not necessary to specify for the moment, and which is designated by 2, from a fixed support 3. A flexible tube 4 penetrates inside the reservoir 1, the lower end of the tube being located close to the bottom of the reservoir 1 and is therefore immersed in the liquid contained in this reservoir. This flexible tube 4 ends at an applicator 5 which is attached to a receptacle 6 integral with the support. The applicator comprises a vertically disposed needle 7, the tip of which is at a slightly lower level than the level 8 of the liquid in the reservoir 1. In FIGS. 1 and 2, the applicator is shown in the rest position. Periodically, an operator takes it to carry out a gluing operation and then replaces it in the position shown.

The letters A, B and C designate three different levels of the contents of reservoir 1. As the reservoir empties, its weight lessens, so that the spring 2 contracts. The displacement of the reservoir by the spring is regulated so that the level 8 of the liquid remains constantly at the same height. Thus, when the applicator is in its rest position, i.e. fixed to the element 6, the quantity of liquid it contains and which the tube 4 contains, is constantly the same, which ensures that the applicator is always ready for the next fluid dispensing operation.

FIG. 1 shows the action of a pneumatic pulse generator in the form of a pipe 9 opening into an upper area of the reservoir 1, practically in contact with the liquid. This illustration is intended here solely to demonstrate the way in which the system functions. It will be understood that a pulse generator causing momentary excess pressure in the upper cavity of the reservoir will force a precalibrated dose of liquid to pass into the flexible tube 4 and, therefore, a drop will be emitted at the tip of the needle 7. However, in practice, the pneumatic pulse generator may function according to a different but equivalent system and may have, for example, an arrangement avoiding all direct contact between the air and the liquid contained in the reservoir.

Figure 3:
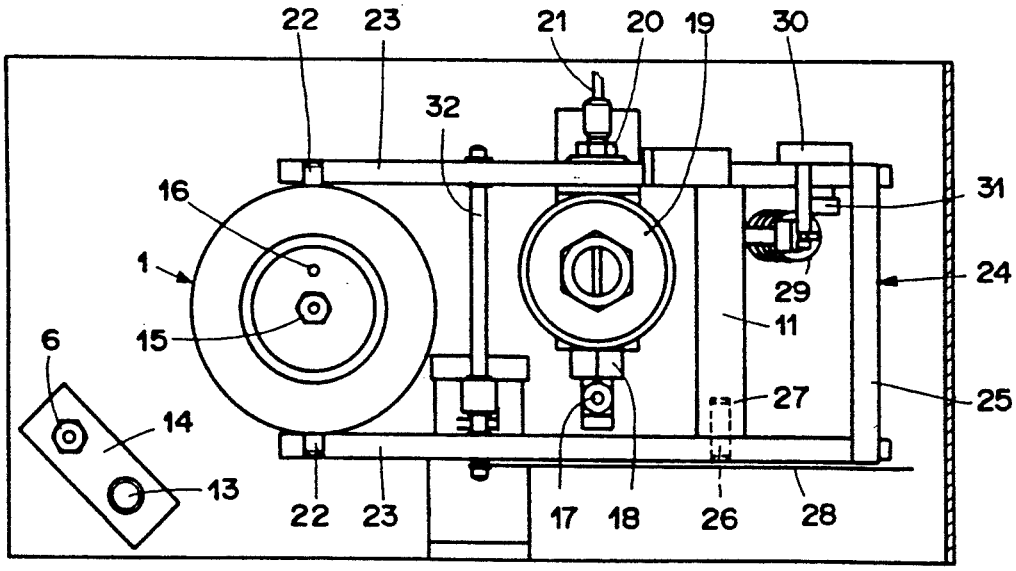
FIG. 3 is a top plan view of the dispenser of FIG. 2.

FIGS. 2 and 3 show an actual embodiment of the device. The support 3 comprises a base plate 10, a rigid upright 11 fixed vertically to the base plate 10, a sheet metal reinforcement wall 12 and a vertical rod 13 on which is fixed a vertically adjustable bracket 14 intended to receive the applicator 5. The attachment element 6 is constituted here by an opening in the bracket 14 adapted to receive the body of the syringe 5, the needle 7 of which is disposed vertically downwards.

FIGS. 2 and 3 also show the reservoir 1, the detailed structure of which it is not necessary to describe completely at this point. A connection piece 15 is disposed on the cover of this reservoir for the passage of the flexible tube 4 which connects the reservoir to the applicator 5. Another opening 16, also disposed in the cover of the reservoir allows pneumatic pulses to be communicated to the reservoir 1 through another flexible tube designated at 17 in FIG. 2. The flexible tube 17 emanates from a connection piece 18 which is integral with the base plate 10 and which passes through a drier 19 and communicates itself, via a connection piece 20, with a feed pipe 21 which directs the pneumatic pulses generated by an electronically controlled device which is known per se and which does not therefore constitute part of this invention.

The reservoir 1 is suspended by means of two diametrically opposed pegs 22 with two parallel arms 23 of a frame 24 comprising a crosspiece at its rear end and bearing two pivot pins 26 which fit into axial bearings 27 contrived horizontally in the upright 11, in the vicinity of its upper end. Thus the frame 24 is articulated on the upright 11 and supports the entire reservoir 1 by its two parallel arms 23, 23. The action of two springs 28 and 29 bent between different locations of the frame and the base 10 or the upright 11, is coordinated to compensate the position of the frame 24 as a function of the degree to which the reservoir is filled 1. Spring 28 is constituted by a thread of curved steel whilst spring 29 is a spiral spring fixed on the one hand to the base of the upright 11, and on the other hand, to an eccentric 30 which is fixed by a screw and a spring 31 to one of the arms 23 of the frame 24 at the back of the upright 11. The eccentric 30 allows easy regulation of the force of the spring 29 and therefore allows the height of the reservoir 1 to be adjusted as its contents increase or decrease.

In the form of embodiment shown in FIGS. 2 and 3, the frame 24 comprises in addition a transverse rod 32 extending between the two arms 23 in the vicinity of the location of the reservoir 1. A vertical rod 33 which enters into a blocking cylinder 34 is fixed to this transverse rod 32. This blocking cylinder, which may be of the electromagnetic or pneumatic type, for example, may be actuated as required and, when it is actuated, blocks the rod 33. The frame is thus rigidly fixed with respect to the support 10, 11 and there is therefore no risk, for example if the device should move, of causing inopportune oscillation of the reservoir 1.

This blocking means is particularly useful when the dispenser described is incorporated with automatic apparatus, for example an apparatus for assembling and gluing parts. In this case it is prudent that the fluid dispenser is placed in the vicinity of the parts at the moment of the fluid dispensing operation and that it may be moved aside during the intervals between these operations. In view of its low weight and reduced dimensions the apparatus described may easily be mounted on a vertical slide, a mobile table or a robot.

It is possible to place a position sensor 35 on the upright 11. In fact, since the position of the frame 24 is constantly determined by the degree to which the reservoir 1 is filled, the frame assumes the limit position when the reservoir is practically empty. The sensor 35 may therefore be placed so as to detect the moment when the frame reaches this limit position so that it will signal, for example, the need to refill the reservoir. When appropriate, the detector may also transmit a command to increase the duration of the pneumatic pulses when the reservoir approaches the completely empty state.

In another embodiment, the stabilizing arrangement described above could comprise a sensor to detect the height of the free level with respect to the reservoir and control means subordinate to the information from the sensor, functioning so as to supply the reservoir from time to time from a fluid reserve container. The control means subordinate to the information from the sensor could comprise, for example, a pump causing fluid to pass from the container to the reservoir, or a clamp comprising a flexible tube which connects the container to the reservoir. Thus, the free level in the reservoir would from time to time be brought back to a fixed height.

The device described is suitable for cyano-acrylate type glues, and for dispensing volatile or aggressive liquids.

In addition to the advantages resulting from the fact that the needle is supplied under stable, constant conditions during the periods of rest, a further feature of the dispenser is that the volumes of air introduced into the reservoir always cause the same excess pressure effect, which was not the case with former apparatuses in which the level of liquid varied as the reservoir emptied.

I claim:

1. A fluid dispenser for dispensing a fluid, comprising:
- an applicator;
- an applicator support having a receptacle for holding the applicator at a predetermined height;
- a reservoir being air-tight and holding the fluid;
- a flexible tube connecting the reservoir to the applicator, said flexible tube having an open end near the bottom of the reservoir;
- a pneumatic pulse generator being connected to the reservoir and producing momentary excess of pressure within said reservoir to create pressure on a surface of the fluid; and
- reservoir support means for holding said reservoir in a stable manner so that the level of the surface of the fluid remains at an approximately constant height with respect to said applicator support during functioning of said dispenser, said reservoir support means comprising:
  - a support;
  - a rigid arm pivoting around a horizontal axis with respect to the support and being connected at one end to said reservoir by an articulated axis; and
  - an elastic suspension having at least one distortable element disposed between the pivoting rigid arm and the support, said at least one distortable element elongating to determine said variable position of the reservoir as a function of the weight, said elastic suspension varying the height of the position of the reservoir with respect to the receptacle based on the amount of liquid in the reservoir so that the level of fluid in the reservoir remains substantially constant in relation to the receptacle as the contents of the reservoir decrease.

2. The fluid dispenser of claim 1, wherein the elastic suspension comprises at least one spring.

3. The dispenser of claim 1, wherein the receptacle is fixed with respect to the applicator support and designed such that when the applicator is in place, the level of fluid in the reservoir is slightly higher than the lower end of a needle of the applicator.

4. The dispenser of claim 1, wherein the pivoting arm takes the form of an elongated frame and wherein the elastic suspension is formed by the joint action of two springs with different characteristics, both affixed to the frame and the support in different locations.

5. The dispenser of claim 1, wherein the reservoir support means further comprises:
- a sensor for detecting the surface level of the fluid in the reservoir:
- a fluid supply container linked to the reservoir; and
- means for supplying the reservoir periodically from the container as the surface level decreases.

6. A fluid dispenser in particular for gluing parts, comprising:
- a glue reservoir;
- an applicator connected to the reservoir by a flexible tube;
- a pneumatic pulse generator for creating momentary excess pressure on a surface of fluid in the reservoir thus ejecting doses of fluid through the applicator;

an applicator support having a receptacle for the applicator; and a reservoir support holding the reservoir, said reservoir support having an upright portion connected to a rigid arm coupled to the reservoir so that the rigid arm pivots around a horizontal axis, and having an elastic suspension with at least one distortable element disposed between the rigid arm and the upright portion so that the level of the surface of fluid in the reservoir remains at an approximately constant level with respect to the applicator held by the applicator support during the functioning of the dispenser, an elongation of said at least one distortable element determines said variable position as a function of the weight of the reservoir.

7. The dispenser of claim 6, wherein the elastic suspension comprises at least one spring.

8. A fluid dispenser in particular for gluing parts, comprising:

a glue reservoir;

an applicator connected to the reservoir by a flexible tube;

a pneumatic pulse generator for creating momentary excess pressure on a surface of fluid in the reservoir thus ejecting doses of fluid through the applicator;

an applicator support having a sliding receptacle for the applicator, said applicator cooperates with a handling device so that the dispenser incorporates an automatic system for gluing parts, wherein the applicator is moved to an operating position when at least one dose of glue is dispensed and moved to a rest position during the intervening periods;

reservoir support means for holding the reservoir in a stable manner so that the level of the surface of the fluid in the reservoir remains at an approximately constant level with respect to the applicator held by the applicator support during the functioning of the dispenser.

9. The dispenser of claim 8, wherein a blocking device control is linked to said automatic system and blocks the position of the reservoir with respect to the support while the slide moves.

10. A fluid dispenser in particular for gluing parts, comprising:

a glue reservoir;

an applicator connected to the reservoir by a flexible tube;

a pneumatic pulse generator for creating momentary excess pressure on a surface of fluid in the reservoir thus ejecting doses of fluid through the applicator;

an applicator support having a receptacle for the applicator; and means for holding the reservoir and a stabilizing arrangement, the latter ensuring that the surface level of the fluid remains at an approximately constant level with respect to the applicator in the applicator support during the functioning of the dispenser;

a blocking device which can be operated at will and which is located between an element for holding the reservoir and the support.

11. A fluid dispenser in particular for gluing parts, comprising:

a glue reservoir;

an applicator connected to the reservoir by a flexible tube;

a pneumatic pulse generator for creating momentary excess pressure on a surface of fluid in the reservoir thus ejecting doses of fluid through the applicator;

an applicator support having a receptacle for the applicator;

means for holding the reservoir by using a pivoting arm and an elongated frame, an elastic suspension is formed by the joint action of two springs with different characteristics, both springs are affixed to the frame and the pivoting arm in different locations so that the height of the position of the reservoir with respect to the receptacle varies as a function of the degree to which it is full, the level of fluid in the reservoir, measured in relation to the receptacle, remaining substantially constant as the contents of the reservoir decrease.

12. A fluid dispenser for dispensing a fluid, comprising:

an applicator;

an applicator support having a receptacle for holding the applicator at a predetermined height, said applicator support being connected to a slide and moving synchronously with a handling device so that the dispenser incorporates an automatic system for dispensing the fluid, said applicator support moving into an operating position when at least one dose is dispensed and moving into a rest position during the intervening periods;

a reservoir being air-tight and holding the fluid;

a flexible tube connecting the reservoir to the applicator, said flexible tube having an open end near the bottom of the reservoir;

a pneumatic pulse generator being connected to the reservoir and producing momentary excess of pressure within said reservoir to create pressure on a surface of the fluid; and reservoir support means for holding said reservoir in a stable manner so that the level of the surface of the fluid remains at an approximately constant height with respect to said applicator support during functioning of said dispenser.

13. The dispenser of claim 12, wherein a blocking device control is linked to said automatic system and blocks the position of the reservoir with respect to the support whilst the slide moves.

14. A fluid dispenser for dispensing a fluid, comprising:

an applicator;

an applicator support having a receptacle for holding the applicator at a predetermined height;

a reservoir being air-tight and holding the fluid;

a flexible tube connecting the reservoir to the applicator, said flexible tube having an open end near the bottom of the reservoir;

a pneumatic pulse generator being connected to the reservoir and producing momentary excess of pressure within said reservoir to create pressure on a surface of the fluid;

reservoir support means for holding said reservoir in a stable manner so that the level of the surface of the fluid remains at an approximately constant height with respect to said applicator support during functioning of said dispenser; and a blocking device being operated at will and being located between an element for holding the reservoir and the support.

* * * * *